US008684594B2

(12) United States Patent
Murakami et al.

(10) Patent No.: US 8,684,594 B2
(45) Date of Patent: Apr. 1, 2014

(54) MAGNETICALLY INSENSITIVE, HIGHLY HARD AND CONSTANT-MODULUS ALLOY, AND ITS PRODUCTION METHOD, AS WELL AS HAIR SPRING, MECHANICAL DRIVING APPARATUS AND WATCH AND CLOCK

(75) Inventors: Yuetsu Murakami, Sendai (JP); Koichiro Jujo, Chiba (JP); Osamu Takahashi, Chiba (JP); Jun Tsuneyoshi, Chiba (JP); Ryo Sugawara, Chiba (JP); Takeshi Takano, Iwate (JP)

(73) Assignees: The Foundation: The Research Institute for Electric and Magnetic Materials, Sendai-Shi (JP); Seiko Instruments Inc., Chiba-Shi (JP)

( * ) Notice: Subject to any disclaimer, the term of this patent is extended or adjusted under 35 U.S.C. 154(b) by 44 days.

(21) Appl. No.: 13/125,831

(22) PCT Filed: Nov. 16, 2009

(86) PCT No.: PCT/JP2009/069458

§ 371 (c)(1), (2), (4) Date: Aug. 5, 2011

(87) PCT Pub. No.: WO2010/055943

PCT Pub. Date: May 20, 2010

(65) Prior Publication Data

US 2011/0286312 A1 Nov. 24, 2011

(30) Foreign Application Priority Data

Nov. 17, 2008 (JP) ..... 2008-293713

(51) Int. Cl.

*G04B 17/06* (2006.01)
*C22F 1/16* (2006.01)
*C22C 30/00* (2006.01)

(52) U.S. Cl.

USPC ..... 368/175; 148/103; 148/315; 148/605; 420/38

(58) Field of Classification Search

USPC ..... 368/175–178; 148/442, 707, 103, 108, 148/315; 420/38

See application file for complete search history.

(56) References Cited

U.S. PATENT DOCUMENTS 2,859,149 A 11/1958 Straumann et al.
3,148,092 A * 9/1964 Shull, Jr. ..... 148/103

(Continued)

FOREIGN PATENT DOCUMENTS

CN 1914347 A 2/2007
GB 918 620 A 2/1963

(Continued)

OTHER PUBLICATIONS

International Preliminary Report on Patentability dated Jun. 21, 2011, issued in corresponding International Application No. PCT/JP2009/069458.

(Continued)

*Primary Examiner* — Amy Cohen Johnson
*Assistant Examiner* — Matthew Powell
(74) *Attorney, Agent, or Firm* — Westerman, Hattori, Daniels & Adrian, LLP

(57) ABSTRACT

A constant-modulus alloy, which has a low saturation magnetic flux density to provide weakly magnetic properties, a high Young's modulus, a low temperature coefficient of Young's modulus, and high hardness, is provided. A hairspring, a mechanical driving apparatus and a watch and clock, in which the alloy is used, are provided. The alloy consists of Co, Ni, Cr, Mo. and Fe. The alloy is healed and cooled before being subjected to repeated wiredrawing and intermediate annealing, forming a wire with a fiber structure having a <111> fiber axis. The wire is then cold rolled into a sheet and heated to obtain optimal magnetic insensitivity and hardness.

12 Claims, 8 Drawing Sheets

(56) References Cited

U.S. PATENT DOCUMENTS

| | | | | |
|---|---|---|---|---|
| 3,673,010 | A | 6/1972 | Matsumoto et al. | |
| 3,788,822 | A | 1/1974 | Hashimoto et al. | |
| 6,285,120 | B1 * | 9/2001 | Park et al. | 313/402 |
| 6,863,435 | B2 * | 3/2005 | Moteki et al. | 368/140 |
| 2003/0196735 | A1 * | 10/2003 | Sugiura et al. | 148/602 |
| 2007/0277913 | A1 * | 12/2007 | Kochi et al. | 148/598 |
| 2008/0115864 | A1 * | 5/2008 | Flatau et al. | 148/621 |
| 2008/0271824 | A1 | 11/2008 | Fujino et al. | |

FOREIGN PATENT DOCUMENTS

| | | | |
|---|---|---|---|
| JP | 31-010507 | B1 | 12/1956 |
| JP | 63-195249 | | 8/1988 |
| JP | 2004-308827 | A | 11/2004 |
| JP | 2006-214822 | A | 8/2006 |
| WO | 0153896 | A1 | 7/2001 |

OTHER PUBLICATIONS

Masumoto Hakaru et al; "On the Elastic Anisotropies and its Temperature Change of Single Crystals of High Elasticity Alloy "Diaflex" in the Co—Fe—Ni—Cr—W—Mo System", Bulletin of Japan Institute Society for Meals (1967); pp. 263-268.

International Search Report of PCT/JP2009/069458, mailing date Feb. 16, 2010.

International Preliminary Report on Patentability (Form PCT/IB/373) of International Application No. PCT/JP2009/069458 mailed May 17, 2011 with Forms PCT/IB/326 and PCT/ISA/237.

Extended European Search Report dated Jan. 15, 2013, issued in corresponding European Patent Application No. 09 826 188.6.

* cited by examiner

MAGNETICALLY INSENSITIVE, HIGHLY HARD AND CONSTANT-MODULUS ALLOY, AND ITS PRODUCTION METHOD, AS WELL AS HAIR SPRING, MECHANICAL DRIVING APPARATUS AND WATCH AND CLOCK

TECHNICAL FIELD

The present invention relates to a constant-modulus alloy, more particularly an Fe—Co—Ni—Cr—Mo based, constant-modulus alloy. In addition, the present invention relates to a hair spring consisting of the constant-modulus alloy, a mechanical driving apparatus comprising the hair spring, and a watch and clock, in which the mechanical apparatus mentioned above is mounted. Specifically, the present invention relates to an Fe—Co—Ni—Cr—Mo based constant-modulus alloy having magnetic insensitivity and impact resistance.

BACKGROUND TECHNIQUE

A conventional constant-modulus alloy having high Young's modulus, and a low temperature coefficient of Young's modulus is based on Fe—Co—Ni—Cr—Mo—W. Such an alloy is used for a hair spring, which in turn is used for a mechanical driving apparatus, which in turn is used for a watch and clock.

Patent Document 1: Japanese Examined Patent Publication (kokoku) No. 31-10507 relates to an Fe—Co—Ni—Cr—Mo—W-based constant-modulus alloy having a composition mainly composed of 8 to 68% Fe, 1 to 75% Co, 0.1 to 50% Ni and 0.01 to 20% Cr, all by weight, and further containing 2 to 20% W and 2 to 20% Mo. However, the present inventors' research revealed that only a partial compositional range of said alloy provides a temperature coefficient of Young's modulus in a range of $(-5\sim+5)\times10^{-5}$ degrees C.$^{-1}$ and saturation magnetic flux density in a range of 2500 to 3500 G. The coefficient of linear expansion and temperature coefficient of elastic modulus were measured but magnetic properties were not measured in Patent Document 1. The production method is described as follows. Molten alloy is cast, an ingot is forged, and wiredrawing or rolling is carried out. Depending on the application of the alloy, wiredrawing or rolling temperature is selected at either ordinary temperature or high temperature. The resultant alloy having a predetermined shape is annealed at 500 to 1100 degrees C., followed by slow cooling. Alternatively, subsequent to the annealing, working at ordinary temperature may be carried out, followed by heating at 750 degrees C. or lower and then slow cooling. In addition to and/or instead of the above process, the ingot may be quenched from a high temperature. An intermediate heat-treatment after wiredrawing is not described.

Non-patent Document 1, "Anisotropy and its temperature dependence of elastic modulus for a single crystal of high elastic alloy," Bulletin of Japan Institute Society for Meals., Vol. 31, No. 3 (1967), pages 263-268, measures anisotropy of elastic modulus of a crystal, which has a composition (wt %) of 22.4% Fe, 38.0% Co, 16.5% Ni, 12.0% Cr, 4.0% Mo, 4.0% W, 1.2% Mn, 1.0% Ti and 0.8% Si. This composition falls within the compositional range of Patent Document 1. Dia-flex has a "high" elastic modulus and is used as a mainspring but is not a constant-modulus alloy.

Generally, a single crystalline alloy having a face centered cubic lattice has the following relationship of Young's modulus in <100> direction $E_{<100>}$, Young's modulus in <110> direction $E_{<110>}$, and Young's modulus in <111> direction $E_{<111>}$.

$$E_{<100>}<E_{<110>}<E_{<111>}$$

As is described in Non-patent Document 1, $E_{<111>}$ of Fe—Co—Ni—Cr—Mo—W based alloy is approximately three times as high as $E_{<}100>$. Among the crystal orientations of a face center cubic lattice alloy, Young's modulus is the highest in <111> orientation. However, constant modulus property is not attained in a single crystalline multi-component alloy having a face centered cubic lattice. In addition, Non-patent Document 1 describes that high elasticity alloys used at present for a commercial mainspring are principally oriented to {110}<112>, which direction is of low Young's modulus. Meanwhile, the relationship between the texture and constant modulus property is not elucidated for a polycrystalline multi-component alloy having a face centered cubic lattice.

FIG. 1 shows the relationship between Young's modulus and measurement temperature for Alloy No. I (comparative example), Alloy No. II (comparative example) and alloy No. 12. The wires drawn at a working ratio of 85.3% were subsequently rolled at a rolling reduction of 50%. The resultant sheets were heated at 650 degrees C. for 2 hours. Note that an intermediate heat treatment is not performed between wiredrawing steps of these alloys. Alloy No. I, which is a commercially available constant-modulus alloy (a registered trademark Elcolloy is owned by one of the present applicants), has a composition of Fe—27.7% Co—15.0% Ni—5.3% Cr—4.0% Mo. Sheet-like samples of respective alloys exhibit relationships between Young's modulus and measurement temperature as shown in FIG. 1. Young's modulus has a flat region in the vicinity of room temperature, that is, 0 to 40 degrees C., where elasticity is constant. Such an alloy is shaped into a hair spring and is mounted in a mechanical driving apparatus, which in turn is used in a watch and clock. Magnetic transforming point of this alloy is 200 degrees C. and is positioned in a vicinity of the peak of a Young's-modulus temperature-dependent curve. This alloy is ferromagnetic and has a saturation magnetic flux density of as high as 8100 G. Therefore, this alloy involves a drawback that it is easily magnetized in an external magnetic field described in detail hereinafter.

PRIOR ART DOCUMENTS

Patent Documents

Patent Document 1: Japanese Examined Patent Publication (kokoku) Sho31-10507

Patent Document 2: WO 01/053896 (Published Japanese Translation of a PCT Application)

Non Patent Document

Non-patent Document 1: Anisotropy and its temperature dependence of elastic modulus for a single crystal of high elastic alloy "Dia-flex" Bulletin of Japan Institute of Metals, Vol. 31, No. 3 (1967), pages 263-268

DISCLOSURE OF INVENTION

Problems to be Solved by Invention

In recent years, high-performance permanent magnets are frequently used in electronic machinery and appliances, and watches and clocks have increasing chances to be exposed to external magnetic field. Intensity of such external magnetic field tends to further increase. Various members mounted in a watch and clock are influenced by magnetization, so accurate time keeping of the watch and clock is seriously affected.

Particularly, since constant-modulus alloy used for a hair spring in a mechanical driving apparatus and a watch and clock is ferromagnetic and exhibits high saturation magnetic flux density, accuracy of a watch and clock is greatly influenced by the intensity of external magnetic field. A magnetic resistant structure is, therefore, mounted in a watch and clock to prevent any influence under such magnetic field, which makes the watch and clock structure complicated.

Under the circumstances described hereinabove, the following are required for the constant-modulus alloy to ensure accuracy of a watch and clock: (a) low saturation magnetic flux density so as to attain weakly magnetic properties and insensitivity to external magnetic field, (b) high Young's modulus, (c) low temperature dependence of Young's modulus, and (d) high hardness so as to realize an impact resistance capable of withstanding external impact.

It is, therefore, an object of the present invention to provide an Fe—Co—Ni—Cr—Mo based constant-modulus alloy, which has a low saturation magnetic flux density to provide weakly magnetic properties and also fulfills the various properties (a)-(d) mentioned above by texture controlling.

Means for Solving the Problems

In view of the above-described circumstances, the present inventors previously made energetic research to develop a constant-modulus alloy which is insensitive to an external magnetic field. However, since constant-modulus property is attributable to magnetism, it is extremely difficult to simultaneously fulfill the following two physical properties, that is, weakly magnetic properties and constant-modulus property. At the outset, the present inventors performed detailed research on the constant-modulus alloy of Patent Document 1. Specifically, the present inventors finely regulated blending of ferromagnetic elements, i.e., Fe, Co, Ni, and non-magnetic elements, i.e., Cr, Mo, and made detailed researches. However, mere control of the amounts of the components was unsuccessful to attain weakly magnetic properties and constant modulus property simultaneously.

Specifically, the amounts of the non-magnetic elements (Cr, Mo) in Alloy No. II were increased compared with that of Alloy No. 1. Such amounts in Alloy No. 12 were furthermore increased compared with that of Alloy No. II. This resulted in a successive decrease in saturation magnetic flux density of Alloys No. II and No. 12. Relationship between Young's modulus and measurement temperature of these alloys is shown in FIG. 1. As is shown in this drawing, the peak of the curve of Young's modulus versus temperature shifts to a low-temperature side in alloys with higher amounts of non-magnetic elements Cr, Mo. This is readily weakening the magnetic properties. Although not shown in FIG. 1, saturation magnetic flux density is decreased and magnetic transformation point Tc shifts to a low temperature side, in alloys with higher amount of non-magnetic elements. However, the temperature dependence of Young's modulus of Alloys Nos. II and 12 at ordinary temperature is large as compared with the case of Elcolloy (Curve I). In order to provide the constant modulus property, temperature coefficient of Young's modulus must be low in the vicinity of ordinary temperature, i.e., 0 to 40 degrees C. The constant modulus property is therefore not attained in Alloy Nos. II and 12. Alloy No. 12 shown in FIG. 1 corresponds to a comparative example of Table 1 shown hereinbelow. In the comparative example, wiredrawing is carried out at a working ratio of 85.3%. Rolling is carried out at a rolling reduction of 50%. Heating is then carried out at 650 degrees C. for 2 hours. Intermediate annealing is not carried out. The composition of this alloy falls within an inventive compositional range as shown in FIG. 2 but the {110}<111> texture was intentionally not formed.

Accordingly, the present inventors further performed research and first specified a compositional range of the Fe—Co—Ni—Cr—Mo based constant-modulus alloy. Based on the specified composition, the present inventors systematically studied how the fiber structure of wires having multi-component polycrystalline face centered cubic structure, texture of sheets, constant modulus property and magnetic properties of the sheets are co-related to one another. As a result, it has been clarified that a constant-modulus alloy, which is weakly magnetic and insensitive to the external magnetic field, can be provided by means of forming a novel texture.

Characteristics of the present invention reside in the following.

(1) The first invention relates to a magnetically insensitive, highly hard, constant-modulus alloy consisting essentially of, by atomic weight ratio, 20 to 40% Co and 7 to 22% Ni, with the total of Co and Ni being 42.0 to 49.5%, 5 to 13% Cr and 1 to 6% Mo, with the total of Cr and Mo being 13.5 to 16.0%, and with the balance being essentially Fe (with the proviso that Fe is present in an amount of 37% or more) and inevitable impurities, characterized in that the alloy has a {110}<111> texture, as well as a saturation magnetic flux density of 2500 to 3500 G, a temperature coefficient of Young's modulus of $(-5\sim+5)\times10^{-5}$ degrees C.$^{-1}$ as measured at 0 to 40 degrees C., and a Vickers hardness of 350 to 550.

(2) The second invention relates to a magnetically insensitive, highly hard, constant-modulus alloy according to item (1) mentioned above, containing 0.001 to 10% in total of one or more of W, V, Cu, Mn, Al, Si, Ti, Be, B, C, each amount being 5% or less, and Nb, Ta, Au, Ag, a platinum group element, Zr, Hf, each amount being 3% or less, as an auxiliary element(s) being, and the total amount of the sum of said Cr and Mo plus the auxiliary elements being 13.5 to 16.0%.

(3) The third invention relates to a magnetically insensitive, highly hard, constant-modulus alloy according to (1) or (2) mentioned above, wherein said {110}<111> texture is formed by: repeating the wiredrawing of material having a non-oriented structure and an intermediate annealing at 800 to 950 degrees C. to form a wire having {111} fiber structure; subsequent rolling of the wire at a predetermined rolling reduction to form a sheet; and subsequently heating the sheet at a temperature of 580 to 700 degrees C.

(4) The fourth invention relates to a magnetically insensitive, highly hard, constant-modulus alloy according to (3) mentioned above, containing, in atomic %, 24.0 to 38.5% Co, 7.5 to 21.0% Ni, 6.0 to 11.6% Cr, and 1.5 to 5.5% Mo.

(5) The fifth invention relates to a magnetically insensitive, high hard, constant-modulus alloy according to (4) mentioned above, which contains, in atomic %, 30.0 to 35.0% Co, 10.0 to 18.0% Ni, 8.0 to 11.0% Cr, and 2.5 to 5.5% Mo.

(6) The sixth invention relates to a magnetically insensitive, highly hard, constant-modulus alloy according to (4) or (5) mentioned above, wherein the working ratio of wiredrawing is 92.8 to 99.9%, and the rolling reduction of rolling is 40 to 80%.

(7) The seventh invention relates to a hair spring consisting of the magnetically insensitive, highly hard, constant-modulus alloy according to any one of (1) through (6) mentioned above.

(8) The eighth invention relates to a mechanical driving apparatus comprising the hair spring according to (7) mentioned above.

(9) The ninth invention relates to a watch and clock, in which the mechanical driving apparatus according to (8) mentioned above is mounted.

(10) The tenth invention relates to a method for producing a magnetically insensitive, highly hard, constant-modulus alloy, characterized in that an alloy having a composition according to (1) or (2) mentioned above is wrought to an appropriate shape by means of forging or hot working; homogenizing by heating to 1100 degrees C. or higher and lower than the melting point, followed by cooling; subsequently, repeating wiredrawing and intermediate annealing at 800 to 950 degrees C., thereby forming a wire at a working ratio of 90% or more; subsequently rolling the wire at a rolling reduction of 20% or more, thereby obtaining a sheet; and, subsequently, heating the sheet at a temperature of 580 to 700 degrees C.

(11) The eleventh invention relates to a method for producing a magnetically insensitive, highly hard, constant-modulus alloy, according to (10) mentioned above, which contains, in atomic %, 24.0 to 38.5% Co, 7.5 to 21.0% Ni, 6.0 to 11.6% Cr, and 1.5 to 5.5% Mo.

(12) The twelfth invention relates to a method for producing a magnetically insensitive, highly hard, constant-modulus alloy according to (10) mentioned above, which contains, in atomic %, 30.0 to 35.0% Co, 10.0 to 18.0% Ni, 8.0 to 11.0% Cr, and 2.5 to 5.5% Mo. The present invention is hereinafter described in the order of composition, texture and properties of the constant-modulus alloy, hair spring, mechanical driving apparatus, watch and clock and production method.

Composition

The composition of an alloy according to the present invention is defined to be 20 to 40% Co and 7 to 22% Ni, with the total amount of Co and Ni being 42.0 to 49.5%, 5 to 13% Cr and 1 to 6% Mo, with the total amount of Cr and Mo being 13.5 to 16.0%, and with the balance being essentially Fe (with the proviso that Fe is present in an amount of 37% or more) and inevitable impurities. The reason why the composition is so defined will become clear from the examples, Tables and drawings provided hereinbelow. When an alloy falls within this compositional range and, further, its texture is controlled to {110}<111>, the alloy has a saturation magnetic flux density of 2500 to 3500 G, a temperature coefficient of Young's modulus of $(-5\sim+5)\times10^{-5}$ degrees $C.^{-1}$ as measured at 0 to 40 degrees C., and a Vickers hardness of 350 to 550.

The resultant constant-modulus alloy is weakly magnetic and hence insensitive to the external magnetic field, and is resistant against any external impact. When the composition lies outside the compositional range mentioned above, the following occurs, so that a magnetically insensitive highly hard constant modulus alloy is not provided. That is, the saturation magnetic flux density is less than 2500 G or more than 3500 G. The temperature coefficient of Young's modulus at 0 to 40 degrees C. is less than $-5\times10^{-5}$ degrees $C.^{-1}$ or more than $5\times10^{-5}$ degrees $C.^{-1}$. Vickers hardness is less than 350 or more than 550. In particular, when the total amount of Cr and Mo is less than 13.5% or exceeds 16.0%, desired properties are not obtained even when texture controlling treatment is performed. A more preferred composition contains 24.0 to 38.5% Co, 7.5 to 21.0% Ni, 6.0 to 11.6% Cr, and 1.5 to 5.5% Mo. A further more preferred composition contains 30.0 to 35.0% Co, 10.0 to 18.0% Ni, 8.0 to 11.0% Cr, and 2.5 to 5.5% Mo.

In addition, 0.001 to 10% in total of the auxiliary elements may be added. They are 5% or less of each of W, V, Cu, Mn, Al, Si, Ti, Be, B, C, and, 3% or less of each of Nb, Ta, Au, Ag, a platinum group element, Zr and Hf. Since any of these elements are non-magnetic, addition of these elements is particularly effective for weakening magnetization and further enhancing insensitivity to external magnetic field. Among the auxiliary elements, any one of Mn, Al, Si and Ti may be added. When is added, deoxidation or desulfurization is necessary, the added element(s) effectively improves forging and working. Addition of any of W, V, Nb, Ta and a platinum-group element is effective for developing a fiber structure having a <111> fiber axis and a {110}<111> texture. Addition of any one of W, V, Nb, Ta, Al, Si, Ti, Zr, Hf, Be, B, C is remarkably effective for enhancing Young's modulus and Vickers hardness. Constant-modulus property and strength are therefore considerably enhanced. The platinum group elements are Pt, Ir, Ru, Rh, Pd, Os. Since these elements provide the same effects, they can be regarded as mutually equivalent components. The total amount of the auxiliary component(s) and Cr, Mo must fall within a range of 13.5 to 16.0% so as to provide a saturation magnetic flux density, a temperature coefficient of Young's modulus and a Vickers hardness as defined by the present invention. The balance of the above composition is inevitably contained impurities resulting from Fe, Co, Ni, Cr, Mo and the like.

FIG. 2 shows an Fe—(Co+Ni)+(Cr+Mo+α) pseudo ternary alloy (α: auxiliary component) having a {110}<111> texture. Lines indicating 2500 G and 3500 G of saturation magnetic flux density Bs as well as lines indicating $-5\times10^{-5}$ degrees $C.^{-1}$ and $5\times10^{-5}$ degrees $C.^{-1}$ of temperature coefficient of Young's modulus at 0 to 40 degrees C. are shown together in FIG. 2 (the unit degrees $C.^{-1}$ is in omitted in the drawing). The range 2500 to 3500 G of Bs is bordered by solid lines, while the range e $(-5\sim+5)\times10^{-5}$ degrees $C.^{-1}$ is bordered by chain lines which extend along and are positioned slightly inside the solid lines mentioned above. Therefore, the above-described properties are obtained in a range sandwiched by the upper and lower curves extending from left to right in the drawing. Within this region, a compositional range of 42.0 to 49.5% (Co+Ni), 13.5 to 16.0% (Cr+Mo+α) and the balance of Fe (with the proviso that Fe is present in an amount of 37% or more) is specified. The present invention thus claims a patent on an alloy which is weakly magnetic and hence insensitive to external magnetic field and has a constant-modulus property. In FIG. 2 the compositional position of each of the Alloys shown in FIG. 1 is indicated by its corresponding numeral label. The atomic weight ratio herein indicates "at" mentioned in FIG. 2 and Table 7.

Texture

The texture of conventional multi-component face-centered-cubic Fe—Co—Ni—Cr—Mo—W high-elasticity alloy was {110}<112> having a small Young's modulus. The texture of the constant-modulus alloy according to the present invention is {110}<111> having a large Young's modulus. As a result, the following properties are apparent.

(a) Non-patent Document 1 anticipates that Young's modulus has the highest value in the <111> direction of a single crystal. The <111> direction having the highest Young's modulus could be formed in an Fe—Co—Ni—Cr—Mo based, multi-component, constant-modulus alloy-sheet having a face centered cubic lattice and a {110}<111> texture. In this texture, the <111> direction is oriented in the rolling direction of a rolled sheet.

(b) Since the {110}<111> texture having a large Young's modulus is formed, the Young's modulus is high over wide temperature range, particularly in the vicinity of ordinary temperature. As a result, its temperature coefficient at 0 to 40 degrees C. becomes so low that a constant modulus property in terms of $(-5\sim+5)\times10^{-5}$ degrees $C.^{-1}$ is obtained. In contrast, when an Fe—Co—Ni—Cr—Mo alloy is drawn at a low working ratio and is not subjected to intermediate annealing, the {110}<111> texture is not formed, as with the case of Alloy No. II (comparative alloy) and Alloy No. 12 shown in FIG. 1. Although Young's modulus of these alloys is generally high, it decreases relatively largely at 40 degrees C. or less. As a result, temperature coefficient of Young's modulus is large and exceeds $5\times10^{-5}$ degrees $C.^{-1}$, so that the constant-modulus property is not provided.

(c) Although non-magnetic elements are contained in Alloys No. II and No. 12 in large amounts, neither weakly magnetic properties nor constant modulus property are attained. In contrast, the saturation magnetic flux density of the inventive alloys is considerably low as is described in detail hereinbelow, because the content of non-magnetic elements is high in the present invention. Since the {110}<111> texture formed has a large Young's modulus, the Young's modulus in the vicinity of ordinary temperature, that is, 40 degrees C. or less, is high and its temperature coefficient is low. The resultant {110}<111> texture having high Young's modulus increases Young's modulus at ordinary temperature of 40 degrees C. or less and decreases its temperature coefficient. The resultant alloy is a weakly magnetic and constant-modulus alloy.

(d) The crystals on the surface of a rolled sheet having a {110}<111> texture, are preferentially oriented parallel to the {110} plane. The crystals, which are observed in a cross section of a rolled sheet perpendicular to the rolling direction, are preferentially oriented to the <111> direction. When the {110}<111> texture is compared with a known {110}<112> texture of a multi-component Fe—Co—Ni—Cr—Mo—W-based high-modulus alloy having a face centered cubic lattice, the preferential orientation in the rolling direction of the inventive texture deviates from the {110}<112> texture by 19.47 degrees. The {110}<111> texture is formed by: repeating the wiredrawing of a material having a non-oriented structure and an intermediate annealing at 800 to 950 degrees C. to develop a <111> fiber structure; and, subsequent rolling of the wire at a predetermined rolling reduction.

Properties (a) Saturation Magnetic Flux Density

Alloy No. I (Comparative Example) shown in FIG. 1 has an extremely high saturation magnetic flux density of as high as 8100 G, while the saturation magnetic flux density of an inventive alloy is 2500 to 3500 G. Permeability of the inventive alloy is correspondingly low. The inventive alloy is thus weakly magnetic and is insensitive to the external magnetic field. The inventive alloy is difficult to be magnetized under such a level of external environmental magnetic field to which appliances comprising a hair spring and the like are exposed. When the saturation magnetic flux density exceeds 3500 G, the weakly magnetic properties are impaired. On the other hand, a saturation magnetic flux density less than 2500 G, is provided at a high content of non magnetic metallic elements. In this case, the magnetic transforming point Tc is as low as 40 degrees C. or less. Since the Young's modulus at the temperature of Tc or less is drastically low, its temperature coefficient becomes larger than $5\times10^{-5}$ degrees $C.^{-1}$. That is, in the case of 40 degrees C. or less of Tc, a constant-modulus property is not obtained, that is, temperature coefficient of Young's modulus $(-5\sim+5)\times10^{-5}$ degrees $C.^{-1}$ at 0 to 40 degrees C. is not attained.

(b) Temperature Coefficient of Young's Modulus

The temperature coefficient of Young's modulus according to the present invention is $(-5\sim+5)\times10^{-5}$ degrees $C.^{-1}$ in a range of 0 to 40 degrees C. and is small. Constant modulus property is therefore excellent. Young's modulus was measured by the natural resonance method in the case of wire and by the dynamic viscoelasticity method in the case of sheet.

(c) Hardness

Vickers hardness of a constant-modulus alloy according to the present invention is as high as 350 to 550. Its mechanical strength is therefore satisfactorily high to use it as a material for producing a hair spring as parts of a watch and clock and the like. When the Vickers hardness exceeds 550, the alloy becomes excessively hard to unevenly form a hair spring. The alloy having a hardness higher than 550 is therefore inappropriate for producing a hair spring of a watch and clock.

Parts

A representative known hair spring is shown in FIG. 3. Its cross sectional dimension is generally approximately 0.1 mm in width and approximately 0.03 mm in thickness. The constant-modulus alloy according to the present invention is preferably used for producing such a hair spring.

Apparatus

Known parts of a mechanical watch and clock are shown in FIG. 4. A balance with a hair spring 340 and a hair spring 342 are structural elements of the mechanical driving apparatus. FIG. 5 is an enlarged view of a balance with a hair spring and a hair spring. A watch is shown in FIG. 6. The parts shown in FIG. 4 are located in the backside of a dial plate. These parts are described in detail in Patent Document 2, Publication of WO 01/053896 in Japan filed by one of the applicants, particularly FIGS. 1, 2 and 10 and their description of item (1) starting at page 9, line 11 from the bottom and ending at page 13, the second line, and from page 4, line 9 to page 5, line 7 from the bottom.

Production Method

Using the following production process, the present inventors could form the {110}<111> texture of a hair spring material. A nonoriented structure is formed through homogenizing treatment. Orientation of the <111> is enhanced in the wiredrawing step with intermediate annealing to form a fiber structure. A sheet of a hair spring is formed by rolling at a specified rolling reduction, followed by heating at a specified temperature. The {110}<111> texture can therefore be formed. The present invention is described hereinafter in the order of steps.

(a) Melting

In the production of an inventive alloy, raw materials are blended to provide a composition of 20 to 40% Co and 7 to 22% Ni, with the total amount of Co and Ni being 42.0 to 49.5%, 5 to 13% Cr and 1 to 6% Mo, with the total amount of Cr and Mo being 13.5 to 16.0%, and with the balance essentially being Fe (with the proviso that Fe is present in an amount of 37%) by atomic weight ratio. Appropriate amounts of the raw materials are melted in an appropriate melting furnace, such as a high frequency induction furnace, in air, preferably in non-oxidizing protective atmosphere (such gases as hydrogen, argon and nitrogen), or under vacuum. The resultant melt of the raw materials is thoroughly stirred. Alternatively, 0.001 to 10% in total, of the auxiliary element(s), that is, one or more of W, V, Cu, Mn, Al, Si, Ti, Be, B, C, and Nb, Ta, Au, Ag, a platinum group element, Zr, Hf, is added to the melt mentioned above, followed by stirring to produce a molten alloy having a uniform composition. Each of W, V, Cu, Mn, Al, Si, Ti, Be, B, and C is 5% or less, and each of Nb, Ta, Au, Ag, a platinum group element, Zr, Hf is 3% or less.

(b) Forging or Hot Working

Subsequently, the molten alloy is poured into a mold having an appropriate shape and size to form a defect-free ingot. The ingot is subjected to working such as forging or hot working to a shape appropriate for wiredrawing, preferably a round bar.

(c) Homogenizing

Homogenizing is carried out by holding at 1100 degree C. or higher and lower than the melting point, preferably 1150 to 1350 degrees C. for an appropriate time, preferably for 0.5 to 5 hours, followed by cooling. When the homogenizing temperature is lower than 1100 degrees C., a solidification structure remains, making it difficult to produce a highly oriented fiber structure. On the other hand, when partial melting occurs, then solidification later occurs. This influence becomes later apparent.

(d) Wiredrawing

Subsequently, the homogenized material is subjected to cold working by means of wiredrawing. When hardening has progressed during working, intermediate annealing is carried out to continue the wiredrawing. The intermediate annealing temperature of 800 to 950 degrees C., preferably 850 degrees C. to 950 degrees C. An appropriate intermediate annealing time is preferably 0.5 to 10 hours. Such steps are repeated until a wiredrawing working ratio of 90% or more is attained (i.e., heavy wiredrawing). The working ratio is indicated by ratio of the cross sectional area of a wire before and after the working.

An alloy having the same composition as that of Alloy No. 12 (FIG. 1) was drawn to a wire at different working ratios and was then heated at 650 degrees C. for 2 hours. FIG. 7 shows the relationships between the wire-working ratio and orientation of fiber structure, saturation magnetic flux density Bs, Young's modulus E, and Vickers hardness Hv of the wire. As is shown in the drawing, orientation of <100> fiber structure decreases with the increase in working ratio. In contrast, orientation of <111> fiber axis is outstandingly increased at working ratios of 90% or more. Saturation magnetic flux density Bs, Young's modulus E, and Vickers hardness Hv increase as the <111> fiber-axis orientation increases.

(e) Heating after Wiredrawing

An alloy having the same composition as Alloy No. 12 was subjected to wiredrawing at a working ratio of 99.9%, and the resultant wire was heated at different temperatures. FIG. 8 shows the relationship between heating temperature and orientation of fiber structure. If intermediate annealing is carried out at lower than 800 degrees C., although a highly oriented <111> fiber axis is obtained, the work-hardening due to stress of wiredrawing will not become sufficiently soft, and, subsequent wiredrawing becomes difficult. When the intermediate annealing temperature is in a range of 800 to 950 degrees C., <111> fiber axis is highly oriented. In addition, since work-hardening stress is relieved to soften the structure, subsequent wiredrawing is facilitated. However, when intermediate annealing temperature is higher than 950 degrees C., the <111> fiber axis orientation drastically decreases. Incidentally, if homogenizing treatment described in item (c) above is carried out through heating to a temperature of 1100 degrees C. or higher, the resultant homogenized structure is random and cannot attain preferred orientation, that is, a nonoriented structure is obtained. Therefore, the once formed solidification structure does no more exist at all at heating at a temperature of 1100 degrees C. or higher and lower than the melting point. The resultant structure is homogeneous and is free from the orientation. Drawing is then carried out to form a wire. Intermediate annealing in a temperature range of 800 to 950 degrees C. applied to such wire further enhances an orientation of <111> fiber axis of the fiber structure. This wire is further subjected to wiredrawing, thereby further more enhancing the orientation of <111> fiber axis. Repeated cycles of wiredrawing and intermediate annealing in a temperature range of 800 to 950 degrees C. is very effective for the purpose of enhancing the orientation of <111> fiber axis. In such a case, the wiredrawing working ratio corresponds to total working ratio of the wiredrawing step as a whole.

(e) Rolling Working

Alloy No. 12 (working ratio of 85.3% without intermediate annealing in FIG. 1) was repeatedly subjected to wiredrawing and intermediate annealing at approximately 900 degrees C. for 2 hours for several times. Wiredrawing at a working ratio of as high as 99.9% was carried out. Then, a further intermediate annealing was carried out at 900 degrees C. for 2 hours under vacuum. FIG. 9 shows an inverse polar figure of the fiber structure of heated wire. It is understood that the wire has a fiber structure having a <111> fiber axis highly oriented to the <111> axial direction. After wiredrawing attained a working ratio of as high as 99.9%, the wire was rolled at a rolling reduction of 50% in the direction of wire. The resultant sheet was then heated at 650 degrees C. for 2 hours. A {111} pole figure of the rolled surface of this heated sheet is shown in FIG. 10. The inverse pole figure and the pole figure was are measurement of orientation by EBSP (Electron Back Scattering Pattern Analysis). It is clear from these Figs. that a {110}<111> texture of high orientation is formed.

A wire having a highly oriented <111> fiber structure was rolled in its axial direction. When the rolling reduction of rolling is less than 20%, only a fiber structure having a <111> fiber axis is maintained. When the rolling reduction of rolling is 20% or more, a {110}<111> texture having a high Young's modulus becomes to appear and a sheet having a constant-modulus property is obtained. That is, repeated heavy wiredrawing with intermediate annealing forms a highly oriented fiber structure. Subsequent rolling induces the formation of a {110}<111> texture. The highly oriented fiber structure provides a driving power to promote the texture formation. Young's modulus of a sheet having a {110}<111> texture is generally higher than that of a wire having a <111> fiber axis.

(f) Heating after Rolling Working

Alloy No. 12 was wire-drawn at different working ratios and the resultant wires were then rolled in the axial direction at a constant rolling reduction of 50%. Heating was then carried out at a constant temperature of 650 degrees C. for 2 hours. The relationship between Young's modulus E of a sheet and measurement temperature is shown in FIG. 11. With the increase in wiredrawing working ratio, a {110}<111> texture having a high Young's modulus is effectively formed. Also, the peak of Young's modulus temperature-dependent curve (Tc temperature) shifts to a high temperature side of 40 degrees C. or higher. In addition, Young's modulus at 40 degrees C. or less is increased. When the rolling reduction is 90% or more, temperature coefficient of Young's modulus at 0 to 40 degrees C. is low. The resultant elastic modulus is $(-5\sim+5)\times10^{-5}$ degrees $C.^{-1}$ and is thus constant.

In the case of Alloy No. 12 shown in FIG. 7, saturation magnetic flux density Bs increases with the increase in wiredrawing working ratio. The peak of a Young's modulus temperature-dependent curve shifts to a high temperature side in FIG. 11 with the increase in wiredrawing working ratio. It is presumed from FIG. 7 that Tc is also enhanced and the saturation magnetic flux density Bs increases in FIG. 11 with the increase in the wiredrawing working ratio.

The same treatment as in FIG. 11 is carried out in FIG. 12. With the increase in wiredrawing working ratio, a {110}<111> texture having a high Young's modulus E is effectively formed, and the Young's modulus E is increased. When rolling reduction is 90% or more, temperature coefficient of Young's modulus e at 0 to 40 degrees C. is low. The constant modulus property in terms of $(-5\sim+5)\times10^{-5}$ degrees $C.^{-1}$ is thus constant.

Alloy No. 12 was drawn at a working ratio of 99.9% to form a wire. The wires were rolled in its axial direction at a rolling reduction of 50% and were heated at different temperatures. FIG. 13 shows the relationship between heating temperature and saturation magnetic flux density Bs, temperature coefficient of Young's modulus E at 0 to 40 degrees C. (e), and Vickers hardness Hv. Heat treatment at 580 to 700 degrees C. results in formation of a {110}<111> texture and increase in Young's modulus. As a result, its temperature coefficient at 0 to 40 degrees C. is low; the constant modulus property in terms of $(-5\sim+5)\times10^{-5}$ degrees $C.^{-1}$ is obtained, the saturation magnetic flux density is 2500 to 3500 G, and the Vickers hardness is 350 to 550. However, when the heating temperature is lower than 580 degrees C., Bs exceeds 3500 G and magnetic insensitivity is thus lost, e is less than $-5\times10^{-5}$ degrees $C.^{-1}$ and the constant modulus property is thus lost, and the hardness Hv exceeds 550 and is thus excessively high. On the other hand, when heating temperature is very high, for example, higher than 700 degrees C., although the saturation magnetic flux density is less than 2500 G and hence the magnetic insensitivity is ensured, the following occurs. That is, the work strain is excessively relieved so that the recrystallized structure is softened and the hardness is lower than Hv350. Impact resistance is thus lost so that the alloy is inappropriate for a hair spring. Therefore, appropriate heating temperature is from 580 to 700 degrees C.

Effects of the Invention

The alloy according to the present invention exhibits a saturation magnetic flux density of 2500 to 3500 G and is hence weakly magnetic. The alloy is thus insensitive to the external magnetic field. A {110}<111> texture exhibits high Young's modulus, and its temperature coefficient is low and is improved such that $(-5\sim+5)\times10^{-5}$ degrees $C.^{-1}$ of temperature coefficient of Young's modulus is attained. Since the Vickers hardness is as high as 350 to 550, impact resistance is improved. The alloy according to the present invention is, therefore, magnetically insensitive, highly hard and constantly elastic and is appropriately used for a hair spring and in a mechanical driving apparatus and a watch and clock. The alloy is appropriate not only for such applications but is also suitably used as an elastic material which requires weak magnetism, high elasticity and strength as in general precision appliances.

BEST MODE FOR CARRYING OUT THE INVENTION

The present invention is now described with reference to the examples.

Example 1

Production of Alloy No. 12 (Composition Co=32.0%, Ni=15.0%, Cr=11.6%, Mo=3.0%, Fe=Balance)

Raw materials used were electrolytic iron having a 99.9% purity, electrolytic nickel, electrolytic cobalt, electrolytic chromium and molybdenum. A sample was produced as follows. The raw materials weighing 1.5 kg in total were loaded in an alumina crucible, and were melted in a high-frequency induction furnace under vacuum, followed by thorough stirring to provide a homogeneous molten alloy. The molten alloy was poured into a mold having a cavity of 30 mm in diameter and 200 mm in height. The resultant ingot was forged into a round bar having a diameter of 20 mm at approximately 1200 degrees C. The round bar was then heated at 1200 degrees C. for 1.5 hours to homogenize, followed by rapid cooling. The homogenized round bar was drawn at ordinary temperature to form a 10-mm wire. This wire was heated at 930 degrees C. for 2 hours under vacuum to thereby perform an intermediate annealing. The round bar was cold drawn at ordinary temperature to form a 5-mm bar. The wire was heated to 900 degrees C. for 3 hours in vacuum as an intermediate heat treatment. The wire was further cold drawn at ordinary temperature into a 2-mm wire. This wire was heated at 880 degrees C. for 3 hours under vacuum to thereby perform intermediate annealing. This wire was further cold drawn at ordinary temperature into a 0.9-mm wire and was then heated at 920 degrees C. for 3 hours under vacuum to thereby perform intermediate heat treating. Subsequently, this wire was cold drawn at a working ratio of 85.3 to 99.9% to form wires having an appropriate diameter within a range of 0.5 to 0.01 mm. The working ratio in the cold drawing steps is as shown in Table 1. Further, cold rolling was carried out at a rolling reduction falling within a range of 50 to 80% as shown in Table 1, to form sheets having an appropriate thickness. These sheets were subjected to heat treatment at an appropriate temperature and time as shown in Table 1. Various properties were measured. The obtained properties are shown in Table 1.

TABLE 1

| Working and Heat Treatment | Saturation Magnetic Flux Density (G) | Young's Modulus (GPa) | Temperature Coefficient of Young's Modulus ($\times10^{-5}$° $C.^{-1}$) | Tensile Strength (MPa) | Vickers Hardness (Hv) |
|---|---|---|---|---|---|
| Wiredrawing at 92.8% of working ratio, rolling at 80% of rolling reduction, then, heating at 630° C. for 3 hours. | 3180 | 230.1 | 0.15 | 2110 | 480 |
| Wiredrawing at 99.9% of working ratio, rolling at 50% of rolling reduction, then, heating at 580° C. for 2 hours. | 3500 | 245.0 | −5.00 | 2200 | 550 |
| Wiredrawing at 99.9% of working ratio, rolling at 50% of rolling reduction, then, heating at 650° C. for 2 hours. | 2950 | 227.5 | 0.26 | 2050 | 450 |
| Wiredrawing at 99.9% of working ratio, rolling at 50% of rolling reduction, then, heating at 700° C. for 2 hours. | 2500 | 220.3 | −0.05 | 1980 | 350 |
| Wiredrawing at 99.9% of working ratio, rolling at 70% of rolling reduction, then, heating at 680° C. for 1 hour. | 2750 | 218.5 | −0.10 | 2010 | 390 |

TABLE 1-continued

| Working and Heat Treatment | Saturation Magnetic Flux Density (G) | Young's Modulus (GPa) | Temperature Coefficient of Young's Modulus ($\times 10^{-5}$° C.$^{-1}$) | Tensile Strength (MPa) | Vickers Hardness (Hv) |
|---|---|---|---|---|---|
| Wiredrawing at 95.2% of working ratio, rolling at 65% of rolling reduction, then, heating at 700° C. for 1 hour. | 2680 | 211.1 | −0.55 | 1960 | 360 |
| (Comparative Example) Wiredrawing at 95.2% of working ratio, rolling at 50% of rolling reduction, then, heating at 550° C. for 5 hours. | 3650 | 229.0 | −12.10 | 2130 | 595 |
| (Comparative Example) Wiredrawing at 85.3% of working ratio, rolling at 50% of rolling reduction, then, heating at 650° C. for 2 hours. | 2430 | 223.5 | 11.10 | 2010 | 310 |
| (Comparative Example) Wiredrawing at 95.2% of working ratio, rolling at 50% of rolling reduction, then, heating at 750° C. for 2 hours. | 2350 | 195.5 | −6.30 | 1850 | 248 |

Example 2

Production of Alloy No. 24 (Composition Co=30.0%, Ni=15.0%, Cr=9.8%, Mo=3.0%, W=1.5%, Fe=Balance)

Raw materials used were electrolytic iron, electrolytic nickel, electrolytic cobalt, electrolytic chromium and molybdenum having the same purity as in Example 1, as well as tungsten having a 99.9% purity. A sample was produced as follows. The raw materials weighing 1.5 kg in total were loaded in an alumina crucible, and were melted in a high-frequency induction furnace under argon protective gas having a total pressure of $10^{-1}$ MPa, followed by thorough stirring to provide a homogeneous molten alloy. The molten alloy was poured into a mold with a square cavity having sides of 28 mm each and a height of 200 mm. The resultant ingot was forged at approximately 1250 degree C. into a square bar having sides of 18 mm each. The square bar was then hot rolled at between 1100 degrees C. and 1200 degrees C. into a round bar having a diameter of 10 mm. The round bar was then heated at 1250 degrees C. for 1.5 hours to homogenize, followed by air cooling. The round bar was cold drawn at ordinary temperature to form a 5-mm wire. This wire was heated at 930 degrees C. for 2 hours under vacuum as an intermediate heat treatment. The wire was further cold drawn at ordinary temperature to form a 2.0-mm wire and was then heated at 920 degrees C. for 3 hours under vacuum as another intermediate heat treatment. This wire was further cold drawn at ordinary temperature to form a 0.8-mm wire and was then heated at 900 degrees C. for 4 hours under vacuum as intermediate heat treatment. Subsequently, this wire was cold drawn at a working ratio within 80.0 to 99.3% into wires having an appropriate diameter. The working ratio in the cold drawing steps is shown in Table 2. Further, cold rolling was carried out at reduction within a range of 40 to 70% as shown in Table 2, to form sheets having an appropriate thickness. These sheets were subjected to heat treatment at an appropriate temperature and time as shown in Table 2. Various properties were measured. The obtained properties are shown in Table 2.

TABLE 2

| Working and Heat Treatment | Saturation Magnetic Flux Density (G) | Young's Modulus (GPa) | Temperature Coefficient of Young's Modulus ($\times 10^{-5}$° C.$^{-1}$) | Tensile Strength (MPa) | Vickers Hardness (Hv) |
|---|---|---|---|---|---|
| Wiredrawing at 99.3% of working ratio, rolling at 60% of rolling reduction, then, heating at 620° C. for 2 hours. | 3250 | 232.7 | 1.08 | 2290 | 510 |
| Wiredrawing at 99.3% of working ratio, rolling at 60% of rolling reduction, then, heating at 660° C. for 1 hour. | 3030 | 220.5 | 0.01 | 2220 | 460 |
| Wiredrawing at 99.3% of working ratio, rolling at 60% of rolling reduction, then, heating at 700° C. for 1 hour. | 2680 | 205.5 | −2.06 | 2150 | 410 |
| Wiredrawing at 98.5% of working ratio, rolling at 65% of rolling reduction, then, heating at 660° C. for 2 hours. | 3050 | 230.3 | 0.82 | 2270 | 480 |
| Wiredrawing at 95.2% of working ratio, rolling at 40% of rolling reduction, then, heating at 660° C. for 1 hour. | 2750 | 215.3 | 1.75 | 2230 | 450 |
| Wiredrawing at 92.8% of working ratio, rolling at 70% of rolling reduction, then, heating at 650° C. for 1 hour. | 2580 | 200.5 | −1.06 | 2180 | 430 |
| (Comparative Example) Wiredrawing at 99.3% of working ratio, rolling at 50% of rolling reduction, then, heating at 550° C. for 3 hours. | 3630 | 239.1 | −9.20 | 2310 | 605 |

TABLE 2-continued

| Working and Heat Treatment | Saturation Magnetic Flux Density (G) | Young's Modulus (GPa) | Temperature Coefficient of Young's Modulus ($\times 10^{-5}$° C.$^{-1}$) | Tensile Strength (MPa) | Vickers Hardness (Hv) |
|---|---|---|---|---|---|
| (Comparative Example) Wiredrawing at 80.0% of working ratio, rolling at 65% of rolling reduction, then, heating at 660° C. for 2 hours. | 2410 | 218.7 | 10.13 | 2130 | 380 |
| (Comparative Example) Wiredrawing at 92.8% of working ratio, rolling at 40% of rolling reduction. then, heating at 750° C. for 2 hours. | 2370 | 198.1 | −6.80 | 1880 | 255 |

Further, sheets of Example 1 (Alloy No. 12), Example 2 (Alloy No. 24) and Alloy No. I (Comparative Example) of Table 7 were used to manufacture a hair spring as shown in FIG. 3. This hair spring was subjected to heat treatment at 650 degrees C. for 2 hours. A mechanical driving apparatus as shown in FIGS. 4 and 5 was assembled incorporating the hair spring therein, and was further assembled to produce a watch shown in FIG. 6. Various properties of the watch were measured.

An apparatus capable applying uniform magnetic field to a watch was used to evaluate the external magnetic field. Direct current magnetic field of different intensities was applied to a watch to be measured. A watch was placed in such a manner that its dial faces upward in the direct-current magnetic field. The direct current magnetic field was applied parallel thereto. The watch was rotated around the axis on which hands were attached, by 30 degrees at each measurement. Measurement was carried out in twelve directions in total. Movement of hands in the applied magnetic field was confirmed in the applied field. Occurrence of stopping of hands was measured in the twelve directions. Its percentage is shown in Table 3.

TABLE 3

Occurence Percentage of Stopping in Direct Current Magnetic Field

| Intensity of External Magnetic Field | | | | |
|---|---|---|---|---|
| A/m | Oe | Alloy No. 12 | Alloy No. 24 | I (Comparative Example) |
| 4,800 | 60 | 0% | 0% | 0% |
| 9,600 | 120 | 0% | 0% | 8% |
| 12,000 | 150 | 0% | 0% | 15% |
| 16,000 | 200 | 0% | 0% | 100% |

The same experiment as above was carried out on a watch and clock, to which magnetic field was applied once. The watch was then located in a place without influence of magnetic field and its rate (loss or gain) was measured. The results are shown in Table 4, which shows how the movement was affected by the application of magnetic field. It was determined how the external magnetic field, which was being applied or had been applied to the watch and clock, exerts influences upon stopping of the watch. In the latter case, where the magnetic field was applied to the watch it was withdrawn from the magnetic field and then tested. An outstanding improvement in properties and accuracy is apparent in comparison with Alloy No. I (Comparative Example). Therefore, when a hair spring according to the present invention is used, it is not necessary to entirely cover a movement by magnetic soft steel as practiced previously, but the magnetic resistance can be greatly improved to such a level to satisfactorily fulfill the specification of the 2nd grade antimagnetic watch and clock stipulated in JIS.

TABLE 4

Change of Rate under Remnant Magnetic Field (Unit Second/Day)

| Intensity of External Magnetic Field | | | | |
|---|---|---|---|---|
| A/m | Oe | Alloy No. 12 | Alloy No. 24 | I(Comparative Example) |
| 4,800 | 60 | 0 | 0 | 8 |
| 9,600 | 120 | 2 | 1 | 34 |
| 12,000 | 150 | 3 | 3 | 47 |
| 16,000 | 200 | 5 | 4 | 72 |

Influence of temperature on a watch and clock was examined by changing the ambient temperature to cause change in the rate. Its temperature coefficient was calculated. Specifically, a watch, mainspring of which had been fully wound, was allowed to stand in a certain temperature environment in such a position that a dial faced upward. After a lapse of 24 hours, loss or gain of a watch and clock per day was measured. The full winding was again carried out, and, the watch and clock was then allowed to stand in the above-mentioned temperature environment. Similar operation was repeated. The tested temperature environments were two levels, that is, 8 degrees C. and 38 degrees C.

A temperature coefficient C of change of rate per day and degree C., was calculated using the following formula. This formula was used for a comparison criterion.

$$C=(R1-R2)/(\theta 1-\theta 2)$$

wherein R1 and R2 are loss or gain per day at the respective temperatures, that is, θ1 and θ2, below (daily rate), and θ1 and θ2 are measurement temperatures of the daily rate, that is, θ1=38 degrees C. and θ2 is 8 degrees C.

The results are shown in Table 5.

TABLE 5

Temperature Coefficient of Watch

| | Alloy No. 12 | Alloy No. 24 | I (Comparative Example) |
|---|---|---|---|
| Sample 1 | 0.07 | 0.07 | 0.13 |
| Sample 2 | 0.04 | 0.07 | 0.17 |
| Sample 3 | −0.01 | 0.00 | 0.15 |

Impact resistance was evaluated by the following method. A watch and clock was held at various directions and was then allowed to fall from a constant height. The directions were three, that is, DU (the dial plate directed upward), 6U (6 O'clock index directed upward), and 9U (9 O'clock index directed upward). Change of clockwise rotation and swing angle before and after the fall were measured. The results are shown in Table 6.

TABLE 6

Comparison of Changes in Swing Angle and Rate by Falling Impact

| | | Alloy No. 12 | | Alloy No. 24 | | I (Comparative Example) | |
|---|---|---|---|---|---|---|---|
| | Direction | Change in Rate Second/Day | Change in Swing Angle Degree | Change in Rate Second/Day | Change in Swing Angle Degree | Change in Rate Second/Day | Change in Swing Angle Degree |
| Sample 1 | DU | 7 | 5 | 6 | 4 | −26 | 14 |
| | 9U | 6 | 4 | 7 | 3 | −20 | 16 |
| | 6U | 7 | 6 | 6 | 5 | −17 | −15 |
| Sample 2 | DU | 6 | 5 | 4 | 4 | −30 | 27 |
| | 3U | 6 | 5 | 3 | 5 | −25 | 25 |
| | 6U | 5 | 6 | 5 | 5 | −30 | 22 |

The position indicates to which direction a watch is located in the measurement of watch's precision (based on ISO 3158)
DU: dial upward.
9U: 9 O'clock hand upward.
6U: 6 O'clock hand upward.

As is shown in the respective test results mentioned above, a watch and clock, in which a mechanical driving apparatus comprising a hair spring produced from the inventive alloy is mounted, exhibits outstandingly improved performances.

Tables 7 and Table 8 show properties of a sheet of the representative alloys. In the Tables, Comparative Examples I and II have small contents of the non-magnetic elements, i.e., Cr and Mo, and thus exhibit high saturation magnetic flux density and low young's modulus.

TABLE 7

| | Composition (at %) (Fe-balance) | | | | | Homogenizing | Working | Rolling |
|---|---|---|---|---|---|---|---|---|
| Alloy Nos. | Co | Ni | Cr | Mo | Auxiliary Components | Temperature (° C.) · Time (hours) | Ratio (%) | Reduction (%) |
| 8 | 32.6 | 15.2 | 11.4 | 2.5 | — | 1100 · 3.0 | 92.8 | 75.3 |
| 12 | 32.0 | 15.0 | 11.6 | 3.0 | — | 1200 · 1.5 | 99.9 | 50.0 |
| 15 | 30.0 | 15.1 | 11.5 | 3.5 | — | 1250 · 1.0 | 98.5 | 55.3 |
| 18 | 28.4 | 14.8 | 9.5 | 5.5 | — | 1200 · 2.0 | 95.2 | 60.5 |
| 24 | 30.0 | 15.0 | 9.8 | 3.0 | W1.5 | 1250 · 1.5 | 98.5 | 65.0 |
| 28 | 32.0 | 16.0 | 10.2 | 1.5 | W2.5 | 1200 · 1.5 | 97.0 | 60.5 |
| 32 | 27.0 | 19.0 | 9.5 | 3.5 | V2.0 | 1250 · 1.0 | 95.2 | 60.5 |
| 36 | 30.6 | 16.4 | 9.7 | 1.5 | V4.2 | 1100 · 5.0 | 98.5 | 55.3 |
| 40 | 33.0 | 14.0 | 10.5 | 2.0 | Cu2.0 | 1300 · 0.5 | 97.0 | 65.0 |
| 43 | 33.0 | 12.0 | 6.0 | 4.0 | Cu3.7 | 1200 · 1.0 | 92.8 | 60.5 |
| 46 | 31.5 | 16.5 | 9.6 | 2.8 | Mn1.8 | 1250 · 1.0 | 98.5 | 60.5 |
| 48 | 27.0 | 16.0 | 9.3 | 2.0 | Mn4.2 | 1200 · 1.5 | 98.5 | 45.8 |
| 50 | 29.0 | 16.2 | 10.8 | 2.5 | Al1.8 | 1150 · 2.0 | 95.2 | 75.3 |
| 53 | 34.7 | 10.3 | 8.2 | 2.5 | Al4.3 | 1100 · 3.0 | 92.8 | 75.3 |
| 56 | 36.0 | 8.5 | 10.2 | 3.5 | Si2.0 | 1200 · 1.0 | 98.5 | 50.0 |
| 58 | 28.0 | 18.0 | 8.0 | 2.5 | Si4.5 | 1150 · 1.0 | 95.2 | 65.0 |
| 61 | 31.0 | 13.0 | 10.2 | 2.0 | Ti1.8 | 1300 · 1.0 | 95.2 | 70.0 |
| 64 | 37.0 | 8.2 | 8.5 | 2.8 | Ti4.0 | 1150 · 2.0 | 95.2 | 72.5 |
| 67 | 38.5 | 7.5 | 10.5 | 2.0 | Be2.7 | 1200 · 1.5 | 98.5 | 55.3 |
| 69 | 31.5 | 12.5 | 7.0 | 2.5 | Be4.3 | 1150 · 1.5 | 97.0 | 65.0 |
| 72 | 28.8 | 16.0 | 10.5 | 2.5 | B2.0 | 1100 · 6.0 | 98.5 | 60.5 |
| 75 | 27.0 | 20.0 | 9.0 | 2.8 | B3.7 | 1250 · 1.0 | 95.2 | 65.0 |
| 78 | 26.0 | 17.0 | 9.5 | 2.7 | C1.7 | 1100 · 2.0 | 99.3 | 55.3 |
| 80 | 31.5 | 15.0 | 9.3 | 2.0 | C3.5 | 1250 · 1.0 | 95.2 | 75.3 |
| 82 | 24.0 | 20.0 | 10.7 | 3.0 | Nb1.5 | 1150 · 1.5 | 95.2 | 75.3 |
| 88 | 32.5 | 13.2 | 8.0 | 3.2 | Nb2.5 | 1200 · 2.0 | 99.3 | 40.0 |
| 96 | 27.0 | 18.0 | 10.0 | 2.0 | Ta2.0 | 1300 · 1.0 | 95.2 | 65.0 |
| 103 | 34.5 | 8.0 | 10.5 | 2.3 | Hf1.0, Pd1.5 | 1150 · 2.0 | 92.8 | 75.3 |
| 110 | 38.0 | 8.3 | 10.0 | 2.5 | Au1.0, Cu2.0 | 1100 · 2.5 | 97.0 | 55.3 |
| 115 | 35.1 | 10.0 | 8.5 | 2.5 | Ta1.5, V2.4 | 1250 · 1.0 | 99.3 | 60.5 |
| 125 | 25.0 | 21.0 | 9.0 | 3.0 | Zr1.5, Ti1.3 | 1150 · 1.5 | 92.8 | 75.3 |
| 132 | 35.0 | 9.0 | 10.2 | 2.0 | Ag1.5, Rh1.5 | 1200 · 1.0 | 95.2 | 75.3 |
| 143 | 32.0 | 15.0 | 9.3 | 3.1 | Ir1.2, Mn1.7 | 1150 · 1.0 | 97.0 | 60.5 |
| 148 | 30.5 | 14.8 | 8.5 | 1.5 | Al1.5, Nb1.2, Be2.0 | 1200 · 1.5 | 99.3 | 45.8 |
| 154 | 32.0 | 15.8 | 9.0 | 2.0 | C1.0, Si1.5, W1.0 | 1150 · 2.5 | 95.2 | 65.0 |
| 165 | 28.5 | 16.5 | 8.5 | 2.0 | B1.5, Pt2.0, Os1.0 | 1100 · 5.0 | 98.5 | 50.0 |
| 167 | 30.5 | 12.5 | 9.3 | 2.8 | Nb1.0, Ru1.0, Mn1.3 | 1250 · 1.0 | 98.5 | 60.5 |
| I (Comparative Example) | 27.7 | 15.0 | 5.3 | 4.0 | — | 1150 · 2.0 | 85.3 | 50.0 |
| II (Comparative Example) | 29.0 | 16.0 | 7.5 | 4.5 | — | 1200 · 1.0 | 85.3 | 50.0 |

TABLE 8

| Alloy No. | Heating Temperature (° C.) · Time (hour) | Saturation Magnetic Flux Density (G) | Young's Modulus (GPa) | Temperature Coefficient of Young's Modulus ($\times 10^{5}$° C.$^{-1}$) | Tensile strength (MPa) | Vickers Hardness (Hv) |
|---|---|---|---|---|---|---|
| 8 | 630 · 5.0 | 3150 | 208.8 | 1.15 | 1980 | 430 |
| 12 | 650 · 2.0 | 2950 | 227.5 | 0.26 | 2050 | 450 |
| 15 | 660 · 1.5 | 2840 | 228.3 | −0.25 | 2100 | 470 |
| 18 | 670 · 1.0 | 3170 | 229.5 | 1.89 | 2180 | 480 |
| 24 | 660 · 2.0 | 3050 | 230.3 | 0.82 | 2270 | 480 |
| 28 | 640 · 3.0 | 3340 | 227.0 | 1.37 | 2290 | 500 |
| 46 | 650 · 2.5 | 3260 | 229.0 | 1.50 | 2250 | 470 |
| 48 | 600 · 5.0 | 2980 | 229.5 | −1.35 | 2300 | 490 |
| 50 | 640 · 3.0 | 3050 | 228.6 | 0.73 | 2240 | 480 |
| 53 | 620 · 6.0 | 3120 | 233.1 | −0.85 | 2350 | 520 |
| 56 | 650 · 2.0 | 2880 | 228.9 | −2.15 | 2310 | 480 |
| 58 | 660 · 2.0 | 2790 | 231.7 | −1.03 | 2330 | 500 |
| 61 | 630 · 3.0 | 3130 | 229.8 | 0.45 | 2290 | 480 |
| 64 | 660 · 2.0 | 2980 | 230.5 | 0.30 | 2250 | 485 |
| 67 | 650 · 2.5 | 2910 | 230.0 | −0.58 | 2280 | 485 |
| 69 | 630 · 1.5 | 3320 | 233.7 | 2.05 | 2300 | 510 |
| 72 | 650 · 3.0 | 3130 | 229.1 | 0.72 | 2270 | 480 |
| 75 | 600 · 5.0 | 2850 | 233.2 | −1.32 | 2300 | 500 |
| 78 | 620 · 2.5 | 3170 | 228.6 | 2.08 | 2290 | 510 |
| 80 | 660 · 2.0 | 3220 | 232.6 | −0.80 | 2280 | 475 |
| 82 | 630 · 5.0 | 2870 | 231.2 | −0.15 | 2300 | 480 |
| 88 | 650 · 3.0 | 3110 | 236.1 | 1.77 | 2360 | 500 |
| 96 | 620 · 3.0 | 3280 | 231.3 | −1.53 | 2280 | 490 |
| 103 | 600 · 5.0 | 3310 | 228.6 | −3.50 | 2320 | 510 |
| 110 | 640 · 2.0 | 2860 | 229.4 | −1.55 | 2280 | 480 |
| 115 | 650 · 2.0 | 3050 | 238.7 | 0.88 | 2320 | 500 |
| 125 | 660 · 1.0 | 3130 | 230.6 | 1.88 | 2300 | 490 |
| 132 | 670 · 2.0 | 2880 | 221.5 | −1.42 | 2280 | 460 |
| 143 | 660 · 2.0 | 3150 | 228.7 | 1.37 | 2220 | 450 |
| 148 | 630 · 2.5 | 2820 | 241.0 | 1.25 | 2370 | 510 |
| 154 | 650 · 3.0 | 3200 | 238.2 | 1.35 | 2350 | 510 |
| 165 | 640 · 2.0 | 2980 | 240.5 | 0.56 | 2390 | 515 |
| 167 | 650 · 1.5 | 2870 | 228.8 | −1.15 | 2300 | 500 |
| I (Comparative Example) | 650 · 2.0 | 8100 | 182.4 | 0.32 | 1880 | 310 |
| II (Comparative Example) | 650 · 2.0 | 5450 | 197.2 | 6.57 | 1920 | 340 |

INDUSTRIAL APPLICABILITY

The alloy according to the present invention has 2500 to 3500 G of saturation magnetic flux density and is weakly magnetic and is insensitive to the external magnetic field. The alloy according to the present invention has $(-5\sim+5)\times10^{-5}$ degrees C.$^{-1}$ of temperature coefficient of Young's modulus at 0 to 40 degrees C. and thus has excellent constant modulus property. In addition, since Vickers hardness is as high as from 350 to 550, the impact resistance is improved. Therefore, the alloy according to the present invention is not only appropriate as a constant-modulus alloy used for a hair spring, a mechanical driving apparatus and a watch and clock, but is also appropriate as constant-modulus or elastic alloy used for general precision apparatuses.

Figure 1:
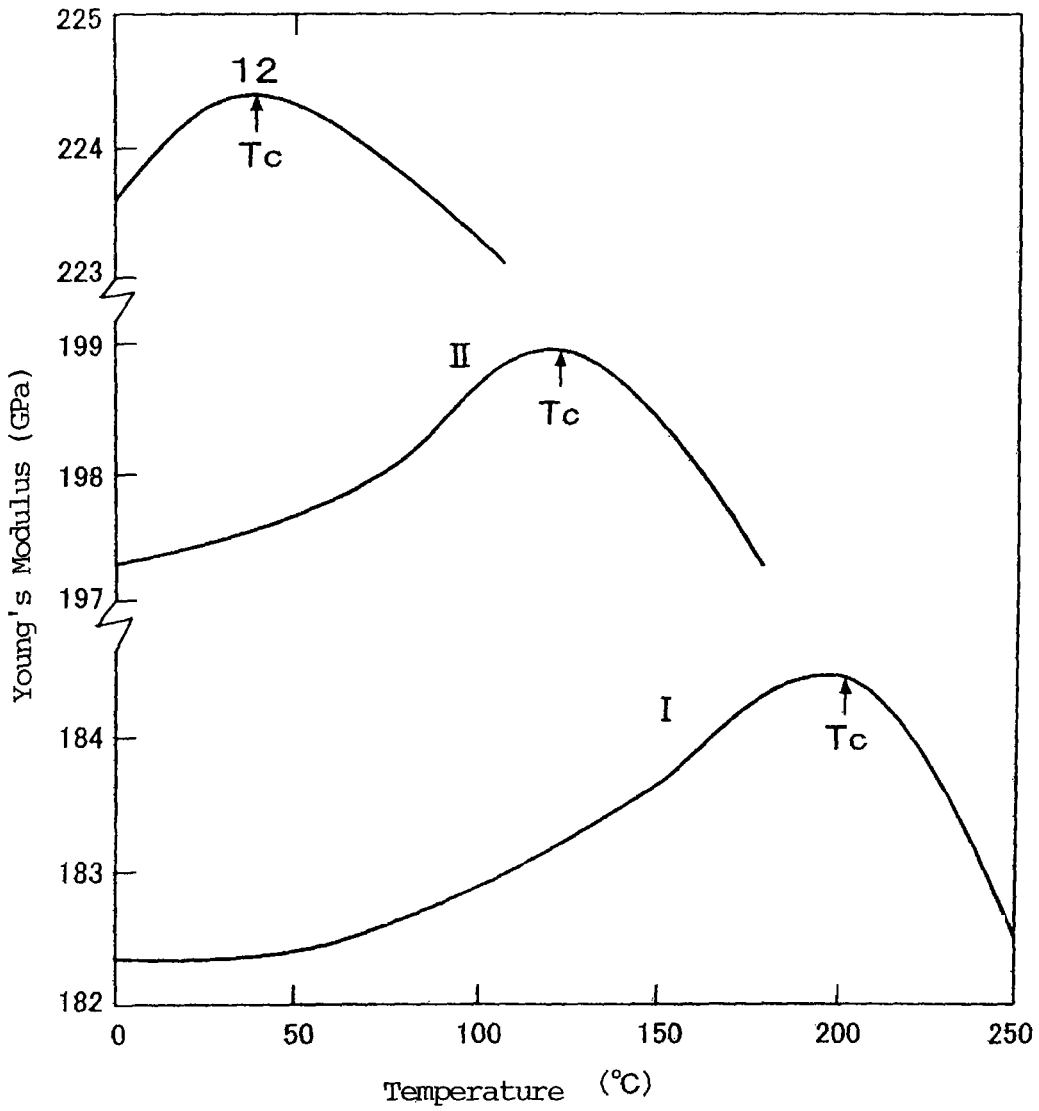
FIG. 1 A characteristic drawing showing the relationship between Young's modulus and temperature of Alloy No. I (Comparative Example), Alloy No. II (Comparative Example) and Alloy No. 12.
Figure 2:
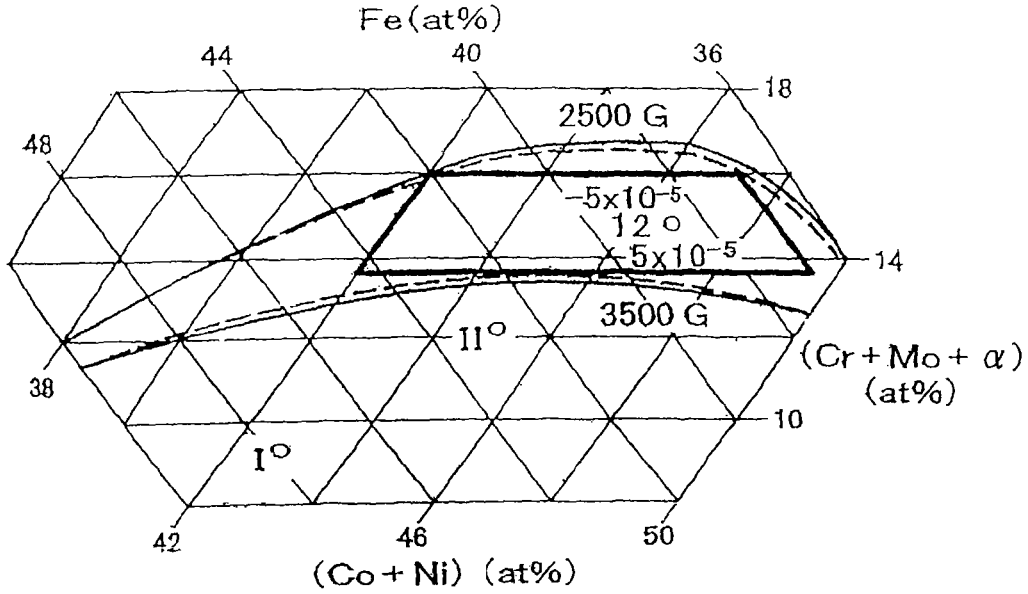
FIG. 2 A characteristic drawing showing the relationships between saturation magnetic flux density, temperature coefficient of Young's modulus and composition of an Fe—(Co+Ni)—(Cr+Mo+α) pseudo ternary alloy.
Figure 3:
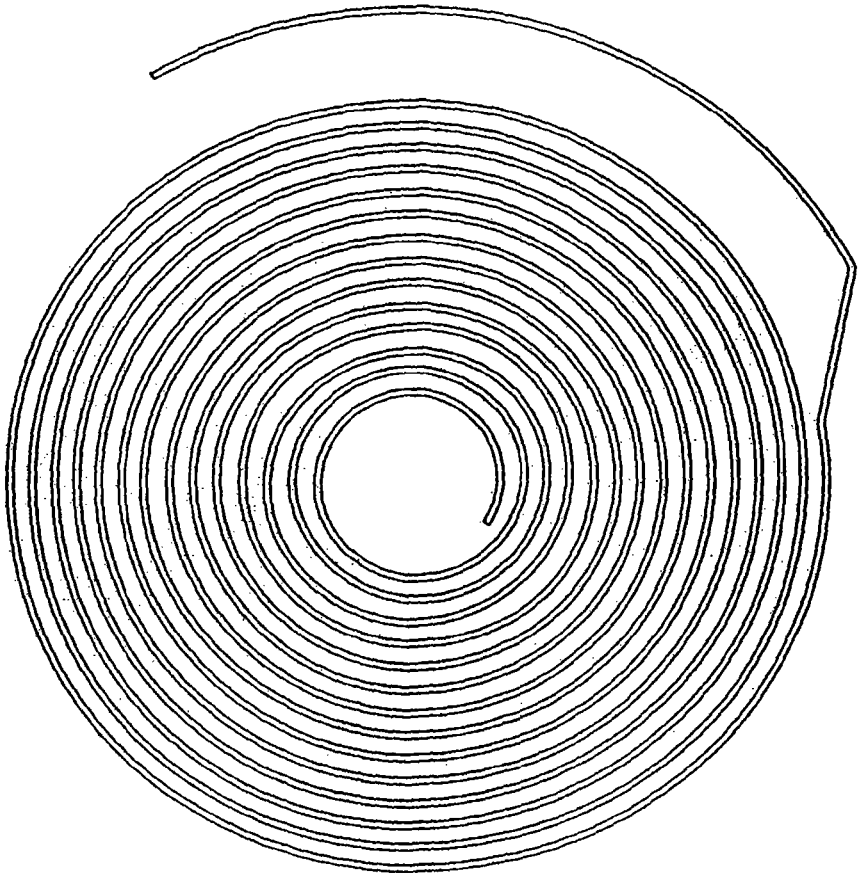
FIG. 3 A drawing of a hair spring.
Figure 4:
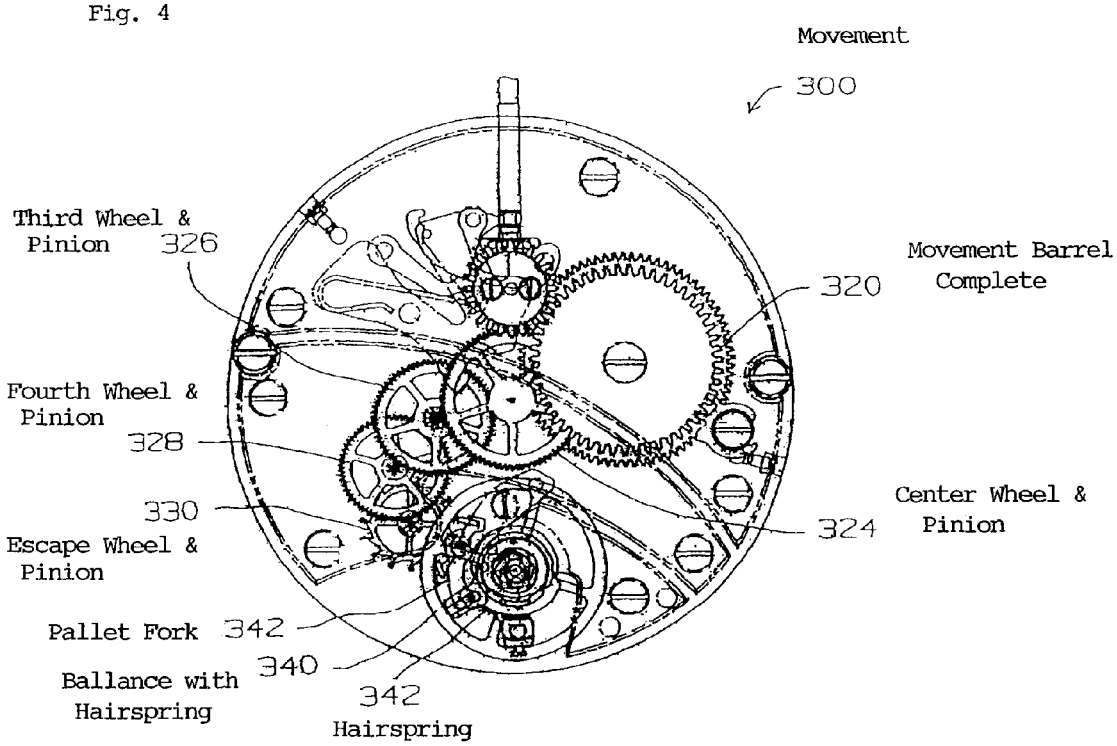
FIG. 4 A drawing of a mechanical driving apparatus.
Figure 5:
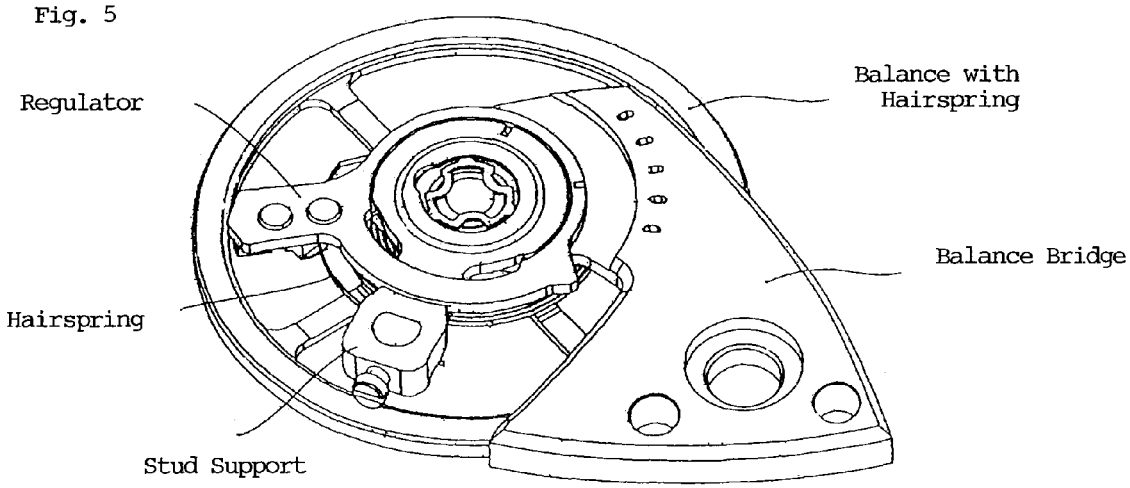
FIG. 5 An enlarged view of FIG. 4.
Figure 6:
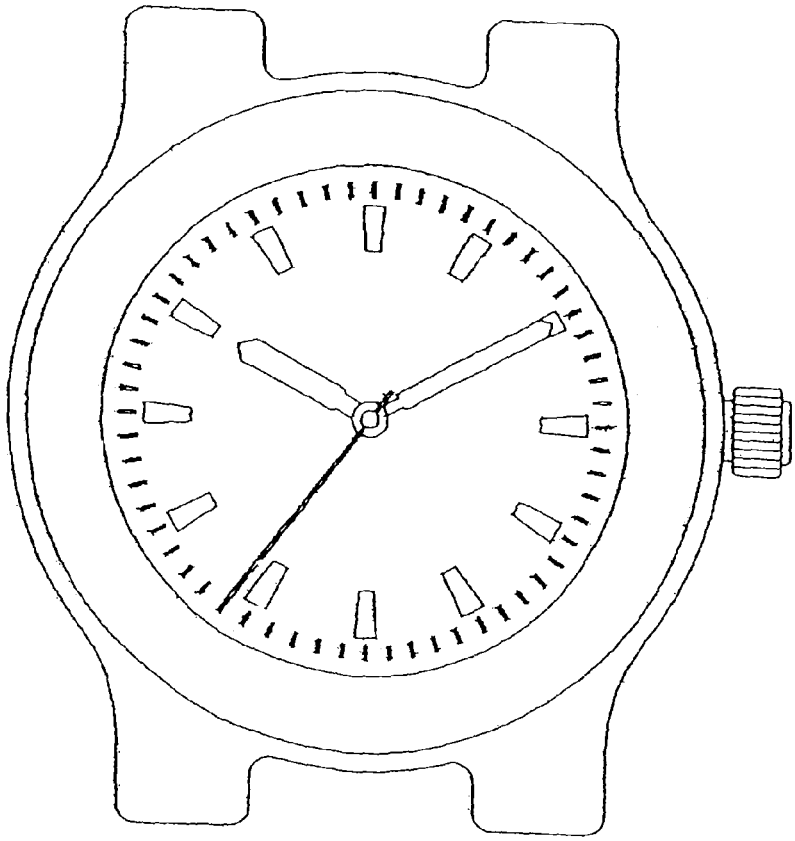
FIG. 6 A drawing of a watch.
Figure 7:
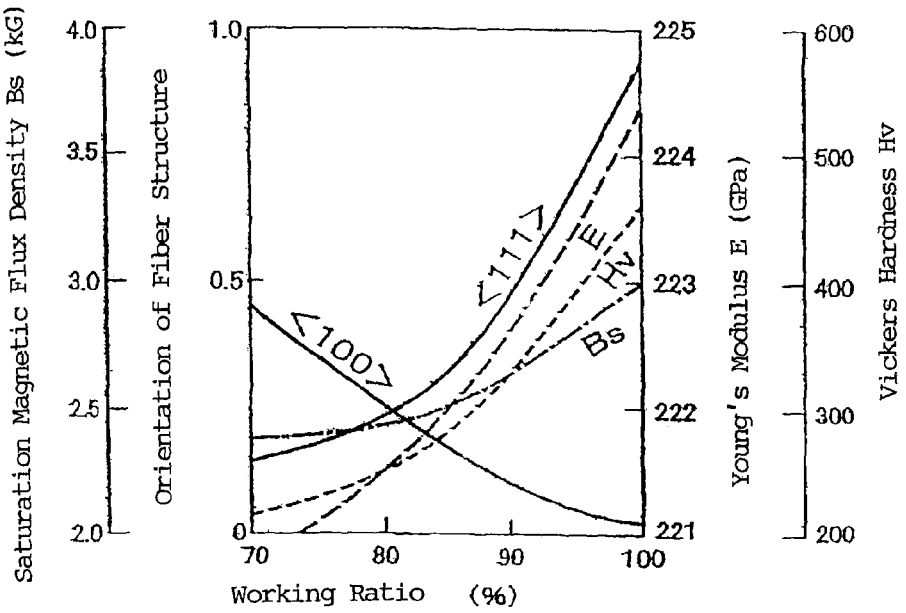
FIG. 7 A characteristic drawing showing the relationships between orientation of fiber structure of a wire, saturation magnetic flux density, Young's modulus and Vickers hardness and working ratio of Alloy No. 12.
Figure 8:
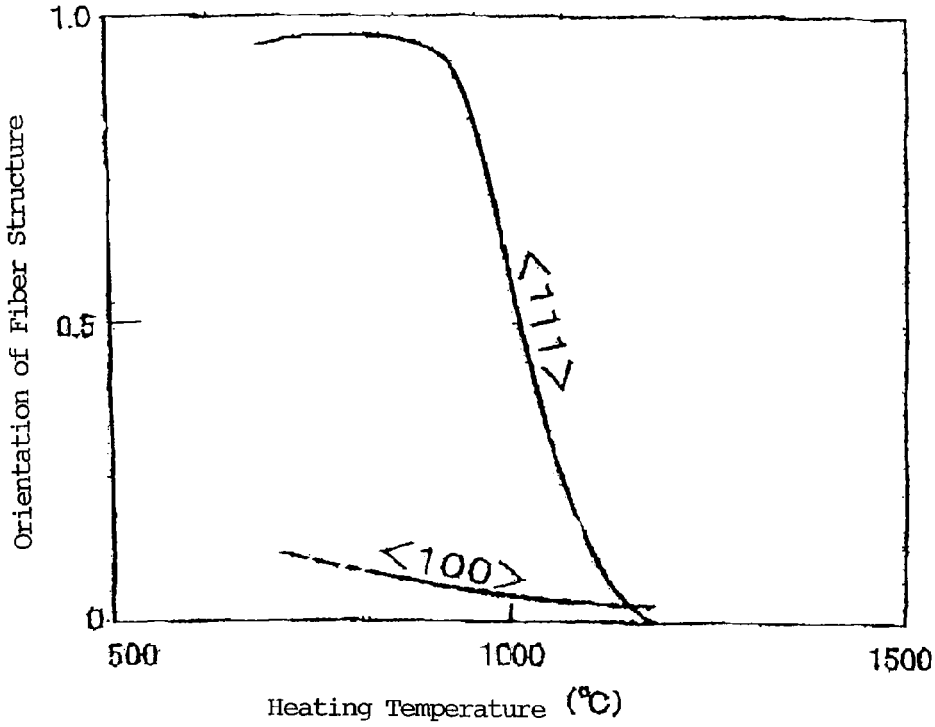
FIG. 8 A characteristic drawing showing the relationships between orientation of fiber structure of a wire and heating temperature of Alloy No. 12.
Figure 9:
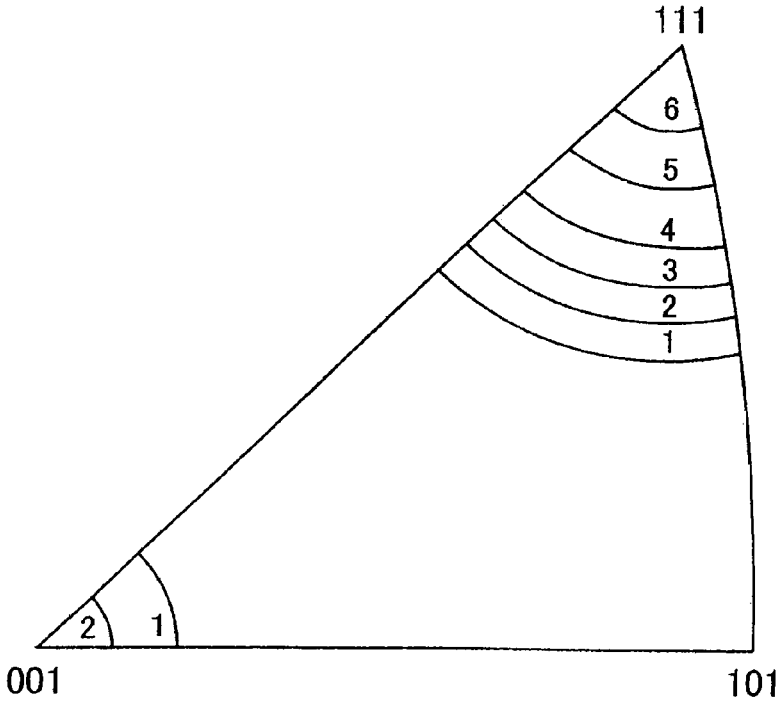
FIG. 9 An inverse polar figure of fiber structure of wire of Alloy No. 12.
Figure 10:
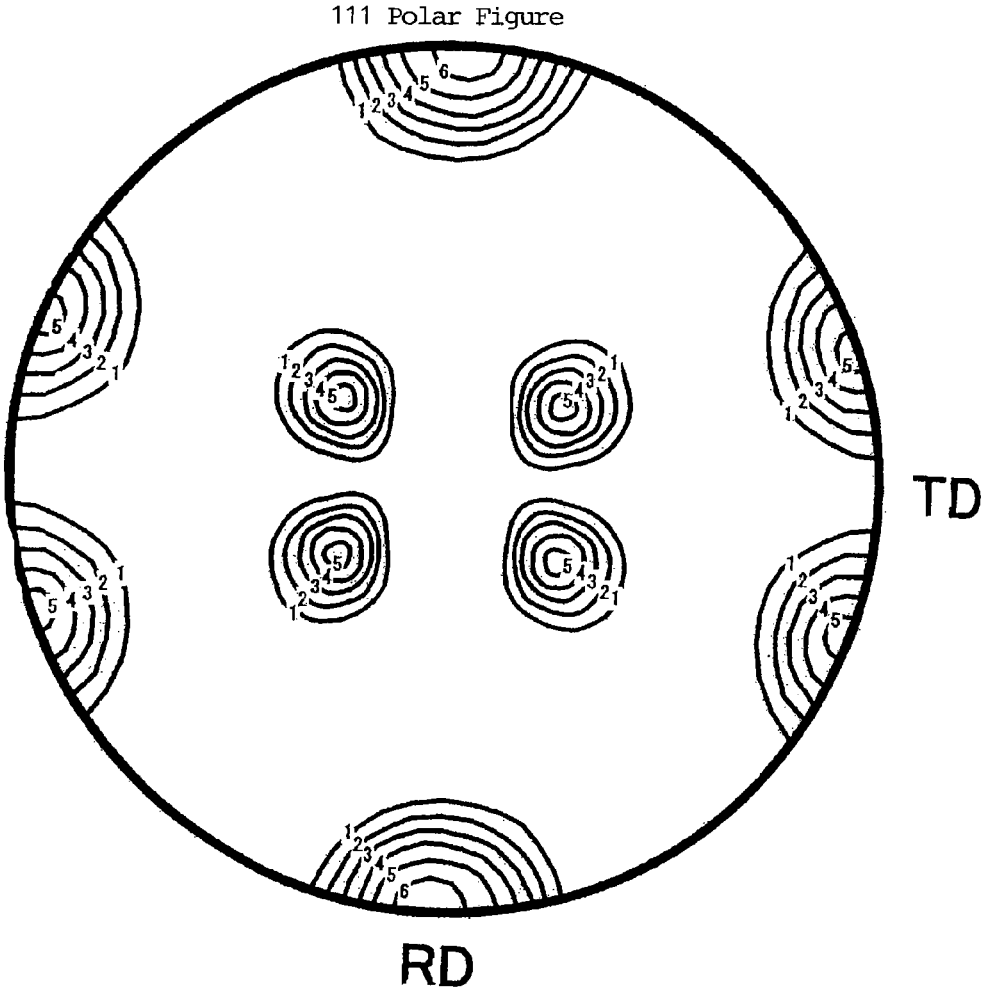
FIG. 10 A {111} polar figure of the rolled surface of a sheet of Alloy No. 12.
Figure 11:
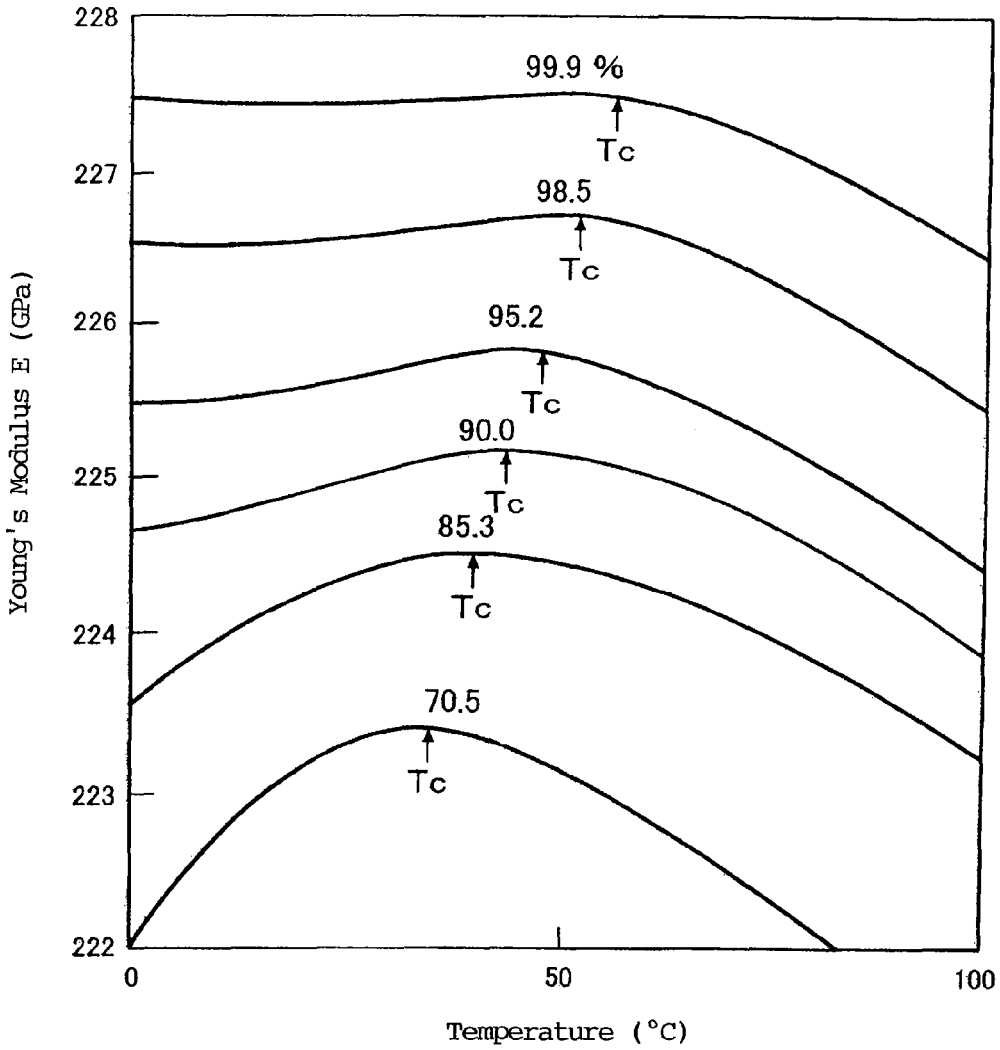
FIG. 11 A characteristic drawing showing a relationship between Young's modulus and temperature with regard to Alloy No. 12.
Figure 12:
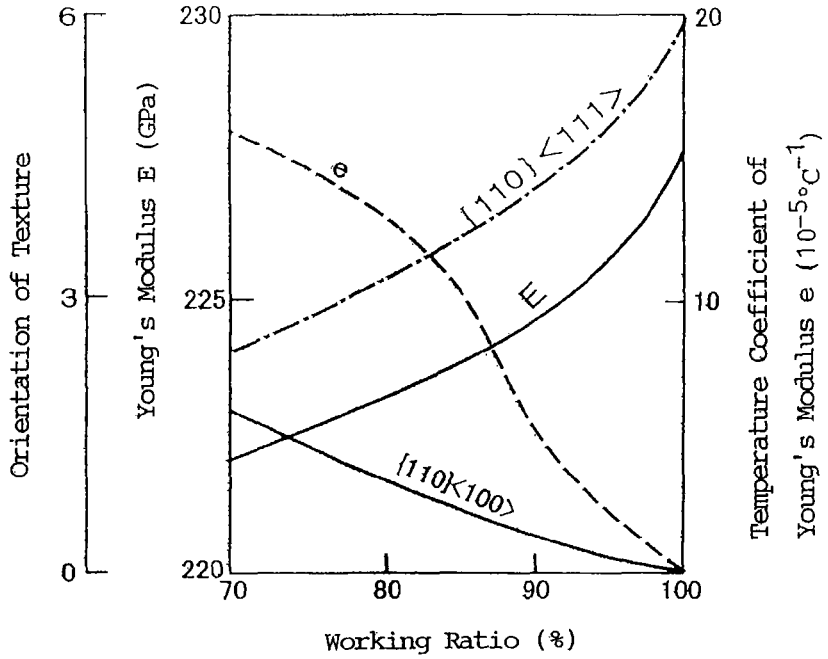
FIG. 12 A characteristic drawing showing a relationship between Young's modulus, its temperature coefficient and Vickers hardness, and working ratio of a sheet of Alloy No. 12.
Figure 13:
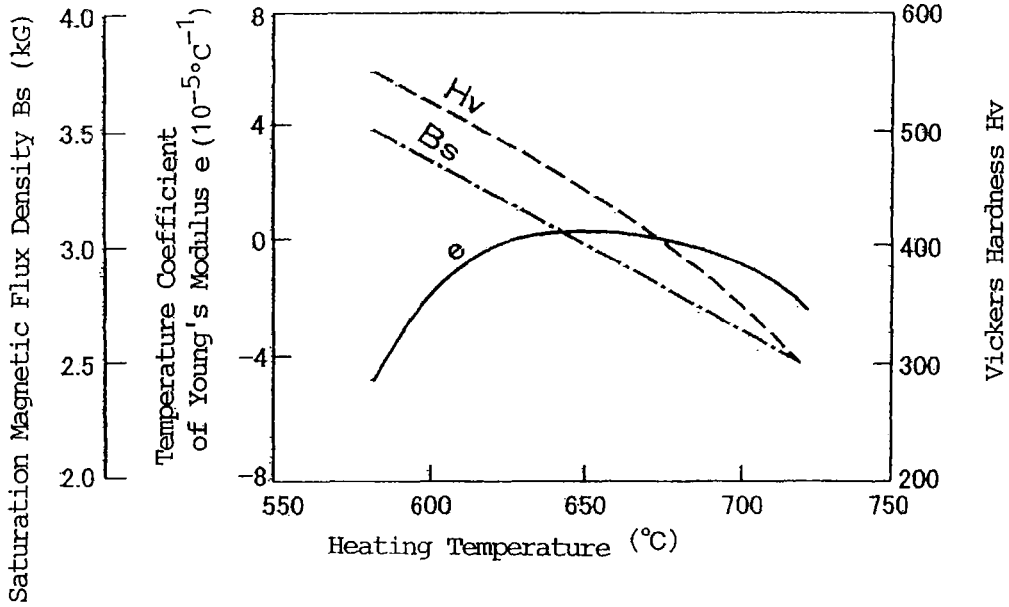
FIG. 13 A characteristic drawing showing a relationship between the saturation magnetic flux density, temperature coefficient of Young's modulus and Vickers hardness and heating temperature of Alloy No. 12.

The invention claimed is:

1. A magnetically insensitive, highly hard, constant-modulus alloy, containing, by atomic weight ratio, 20-40% Co and 7 to 22% Ni, with the total of Co and Ni being 42.0 to 49.5%, 5 to 13% Cr and 1 to 6% Mo, with the total of Cr and Mo being 13.5 to 16.0%, and with the balance being essentially Fe (with the proviso that Fe is present 37% or more) and inevitable impurities, characterized in that the alloy has a {110}<111> texture, as well as a saturation magnetic flux density of 2500 to 3500 G, a temperature coefficient of Young's modulus of (−5~+5)—$10^{-5}$ degrees C.$^{-1}$ of as measured at 0 to 40 degrees C., and a Vickers hardness of 350 to 550.

2. A magnetically insensitive, highly hard, constant-modulus alloy according to claim 1, further containing as an auxiliary element(s) 5% or less of one or more of W, V, Cu, Mn, Al, Si, Ti, Be, B, each, 3% or less of Nb, Ta, Au, Ag, platinum group element, Zr, Hf, total amount of the auxiliary element(s) being 0.001 to 10.0%, the total amount of sum of said Cr and Mo plus the auxiliary elements being 13.5 to 16.0%.

3. A magnetically insensitive, highly hard constant-modulus alloy according to claim 1 or 2, wherein said {110}<111> texture is formed by: wiredrawing of a material having a nonoriented structure; repeating the wiredrawing and an intermediate annealing at 800 to 950 degrees C. to form a <111> fiber structure; subsequent rolling of the wire at a predetermined working ratio; and a subsequent heating at a temperature of 580 to 700 degrees C.

4. A magnetically insensitive, highly hard, constant-modulus alloy according to claim 3, containing, in atomic weight ratio, 24.0 to 38.5% Co, 7.5 to 21.0% Ni, 6.0 to 11.6% Cr, and 1.5 to 5.5% Mo.

5. A magnetically insensitive, highly hard, constant-modulus alloy according to claim 3, containing, in atomic ratio, 30.0 to 35.0% Co, 10.0 to 18.0% Ni, 8.0 to 11.0% Cr, and 2.5 to 5.5% Mo.

6. A magnetically insensitive, highly hard, constant-modulus alloy according to claim 5, wherein the working ratio of wiredrawing is 92.8 to 99.9%, and the rolling reduction of rolling is 40 to 80%.

7. A hair spring formed from the magnetically insensitive, highly hard, constant-modulus alloy according to claim 6.

8. A mechanical driving apparatus comprising the spiral main spring according to claim 7.

9. A watch and clock, in which the mechanical driving apparatus according to claim 8 is mounted.

10. A method for producing a magnetically insensitive, highly hard, constant-modulus alloy, characterized in that an alloy having a composition according to claim 1 or 2, is wrought to an appropriate shape by means of forging or hot working; homogenizing to form a non-oriented structure by heating to 1100 degrees C. or higher and lower than the melting point, followed by cooling; subsequently, repeating wiredrawing and intermediate annealing at 800 to 950 degrees C., thereby forming a wire by at a working ratio of 90% or more; subsequently rolling the wire at a rolling reduction of 20% or more, thereby obtaining a sheet; and, subsequently, heating the sheet at a temperature of 580 to 700 degrees C.

11. A method for producing a magnetically insensitive, highly hard, constant-modulus alloy, according to claim 10 containing, in atomic weight ratio, 24.0 to 38.5% Co, 7.5 to 21.0% Ni, 6.0 to 11.6% Cr, and 1.5 to 5.5% Mo.

12. A method for producing a magnetically insensitive, highly hard, constant-modulus alloy according to claim 10, containing, in atomic weight ratio, 30.0 to 35. % Co, 10.0 to 18.0% Ni, 8.0 to 11.0% Cr, and 2.5 to 5.5% Mo.

* * * * *

UNITED STATES PATENT AND TRADEMARK OFFICE

CERTIFICATE OF CORRECTION

PATENT NO. : 8,684,594 B2
APPLICATION NO. : 13/125831
DATED : April 1, 2014
INVENTOR(S) : Murakami et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 124 days.

Signed and Sealed this
Twenty-ninth Day of September, 2015

Michelle K. Lee

Michelle K. Lee
*Director of the United States Patent and Trademark Office*